US005439290A

United States Patent [19]

Wicks, III et al.

[11] Patent Number: 5,439,290

[45] Date of Patent: Aug. 8, 1995

[54] FLUID FLOW CONDUIT VIBRATOR AND METHOD

[75] Inventors: Moye Wicks, III, Houston, Tex.; Gregory S. Lester, Mandeville, La.; Joe O. Esparza, Katy, Tex.

[73] Assignee: Shell Oil Company, Houston, Tex.

[21] Appl. No.: 310,018

[22] Filed: Sep. 21, 1994

Related U.S. Application Data

[62] Division of Ser. No. 894,667, Jun. 5, 1992, Pat. No. 5,361,830.

[51] Int. Cl.[6] ..... B01F 11/04

[52] U.S. Cl. ..... 366/241; 366/124; 366/280

[58] Field of Search ..... 366/241, 242, 243, 276, 366/348, 349, 280, 114, 108, 124, 126, 336, 338

[56] References Cited

U.S. PATENT DOCUMENTS

| | | | |
|---|---|---|---|
| 2,144,127 | 1/1939 | Scudder | 366/241 |
| 2,513,944 | 7/1950 | Kessler . | |
| 2,730,176 | 1/1956 | Herbold . | |
| 3,101,499 | 8/1963 | Greenfield . | |
| 3,111,171 | 11/1963 | Ferrar et al. . | |
| 3,113,621 | 12/1963 | Krueger et al. . | |
| 3,535,927 | 10/1970 | Mahon et al. . | |
| 3,557,875 | 1/1971 | Solum et al. . | |
| 3,727,890 | 4/1973 | Seidl | 366/126 |
| 3,770,054 | 11/1973 | Solum . | |
| 3,830,294 | 8/1974 | Swanson, Jr. . | |
| 3,908,965 | 9/1975 | Uebel | 366/126 |
| 3,927,566 | 12/1975 | Zanker . | |
| 3,993,290 | 11/1976 | Kovich | 366/241 |
| 4,026,150 | 5/1977 | Schmidt . | |
| 4,291,395 | 1/1981 | Holmes . | |
| 4,323,991 | 4/1982 | Holmes et al. . | |
| 4,366,988 | 1/1983 | Bodine . | |
| 4,469,178 | 9/1984 | Solum . | |
| 4,665,980 | 5/1987 | Bodine . | |
| 4,775,016 | 10/1988 | Barnard . | |
| 4,856,590 | 8/1989 | Caillier . | |
| 4,964,464 | 10/1990 | Myers . | |
| 5,009,272 | 4/1991 | Walter . | |
| 5,036,920 | 8/1991 | Cornette et al. . | |

OTHER PUBLICATIONS

*Oil Well Screens* Brochure, produced by Howard Smith Screen Company, Houston, Tex., Sep. 1982.

*Compoaite Catalog of Oil Field Equipment and Services*, vol. 2, published by World Oil, 1990, p. 3106.

Patent Application Ser. NO. 894,668, filed Jun. 5, 1992, "Gravel Pack Apparatus and Method", by Moye Wicks III and Joe Oscar Esparza (pending).

*Primary Examiner*—Robert W. Jenkins

*Attorney, Agent, or Firm*—Del S. Christensen

[57] ABSTRACT

Vibrations are created in a flow conduit by constraining a bluff object having a plurality of positions between which flow of fluid forces the bluff object. In a preferred embodiment, the vibration technique is utilized in a gravel packing tool. Gravel pack sand is placed while the gravel pack tool is vibrated by balls constrained within a wash pipe. A considerably improved gravel pack density is achieved.

1 Claim, 2 Drawing Sheets

FIG.3
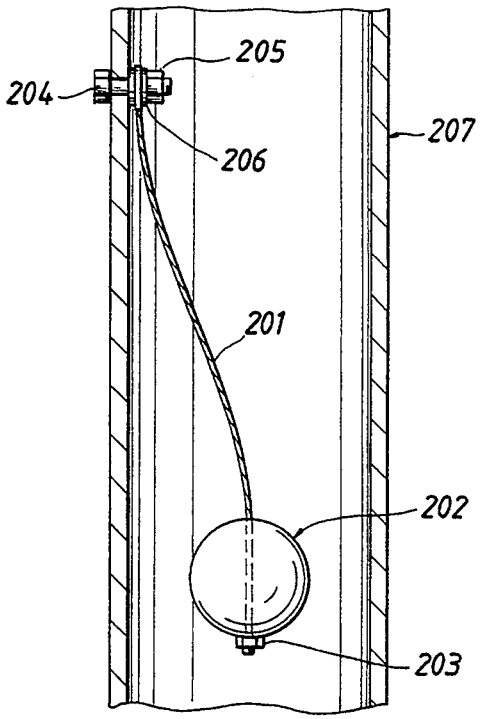
FIG.4
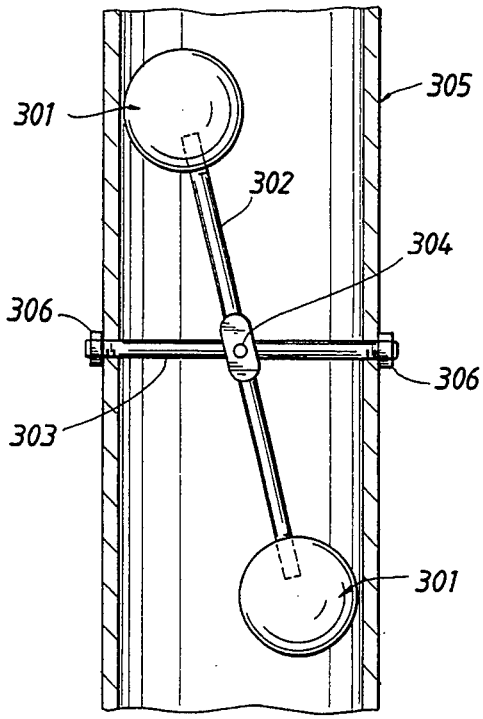
FIG.5
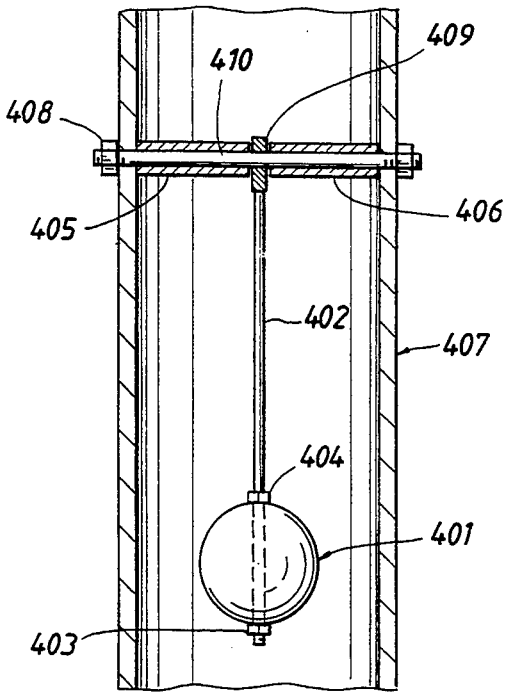
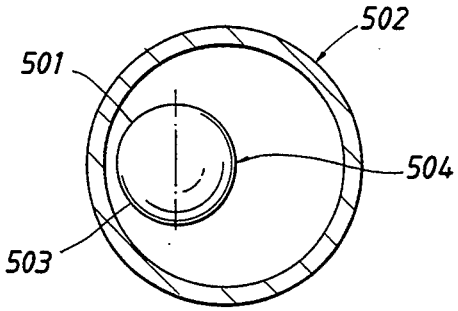
FIG.6

FLUID FLOW CONDUIT VIBRATOR AND METHOD

This is a division of application Ser. No. 07/894,667 filed Jun. 5,1992, now U.S. Pat. No. 5,361,830.

FIELD OF THE INVENTION

This invention relates, in one aspect, to an apparatus and method to impart vibration to a fluid flow conduit. In a preferred embodiment, this invention relates to an improved gravel packing method and apparatus wherein vibration is imparted to the gravel pack apparatus. In another aspect, this invention relates to a method to create a fine dispersion of a first fluid within an immiscible second fluid.

BACKGROUND OF THE INVENTION

Gravel packing of wells involves placing sized gravel or sand within a wellbore external to a screen. The gravel pack sand and screen slots are sized to prevent formation sand migration into the wellbore. Gravel packing is critical to continued oil production from subterranean formations consisting of loosely consolidated or unconsolidated sand. Without an effective gravel pack, the produced sand from the formation will erode equipment and fill tanks and vessels, thus causing the need for shutdowns to clean or replace equipment. Sand can also fill the wellbore and interfere with effective oil lifting. Additionally, displaced sand can leave cavities around the wellbore and thus remove lateral support from well tubulars. Removal of lateral support may result in damage to well tubulars.

The screen is typically hung from a packer and extends downward into a borehole. The borehole can be either cased or uncased. An annulus between the screen and the casing is typically sealed on top and bottom by packers.

Placement of sand around the screen is accomplished by circulating a slurry of sand suspended in a carrier fluid from the surface through a drill string to a crossover tool immediately above the screen. The crossover tool directs the slurry from the drill string to the annulus surrounding the screen. As the slurry travels down the annulus around the screen, some carrier fluid may enter the formation, leaving sand deposited at the perimeter of the wellbore or perforations. The remaining carrier fluid will pass through the screen. The screen has openings that are sized to retain the sand outside of the screen. Sand will therefore be filtered from the slurry by the screen and remain in the annulus outside of the screen. A wash pipe is usually provided within the screen extending from the crossover tool to near the bottom of the screen. Returning carrier fluid, after passing through the screen, enters the washpipe at the lower end of the wash pipe, and travels up the wash pipe to the crossover tool. The crossover tool directs this returning carrier fluid to the annulus outside of the drill pipe, above the screen packers, and up to the surface.

After the annulus outside of the screen is filled with sand, the crossover tool is disconnected from the screen, and removed from the wellbore. The screen is left suspended from packers, surrounded by gravel pack sand. A production tubing is then run to the inside of the screen, along with artificial lift means, if required. A crossover tool is provided to the gravel pack assembly as it is installed in the well. The crossover tool is a removable mechanism attached to the gravel pack packer which directs fluid flow while placing the gravel pack slurry. Slurry is pumped into the drill pipe down the wellbore. The slurry is diverted into the screen annulus via the crossover tool once the slurry reaches the gravel pack packer. The slurry is transported down the screen annulus. As this occurs some may enter the formation and some may enter the screen. Since sand cannot pass through the screen, it is deposited in the screen annulus. Carrier fluid that enters the screen may return up a washpipe which is installed inside the screen. Fluids returning up the washpipe are diverted into the drillpipe/casing annulus above the gravel pack packer via the crossover tool to return to surface.

To be effective, the gravel pack must comprise densely packed sand without voids or cavities in the sand. If portions of the annulus around the screen are not packed completely with sand, formation fluids containing formation sand will quickly erode the screen, leading to a gravel pack failure. Further, if the gravel pack initially is not densely packed, subsequent compaction caused by, for example, flow of the formation fluids, can result in voids and cavities within the gravel pack.

Known methods to increase the density of gravel packs include pulsing the flow of the return fluid as disclosed in U.S. Pat. No. 3,830,294. Pulsing of the fluid flow is helpful in increasing the density of the gravel pack, but merely pulsing the flow imparts a limited amount of energy into the gravel pack, and can have deleterious effects, such as fracturing the formation. Other methods to pulse flows of drilling fluids have been developed for the purpose of transmitting information to the wellhead. These are described in, for example, U.S. Pat. Nos. 4,291,395, 4,323,991, 4,775,016 and 5,009,272. Like '294, these methods may not impart a significant amount of energy into a gravel pack.

A method to vibrate a drillstring and gravel pack apparatus by imparting a sonic frequency vibration which may be a resonant frequency at the wellhead is disclosed in U.S. Pat. Nos. 4,599,031 and 4,665,980. This method would be useful if the drill pipe does not have significant contact with the wellbore or casing above the gravel pack. Unfortunately, this is rarely the case. Wellbores inherently drill in a corkscrew configuration. A drill pipe is therefore in frequent if not almost continuous contact with the wellbore walls or casing. Vibrations imparted at the wellhead can therefore be significantly dampened, and vibrations of only a small magnitude may be present at the gravel packing apparatus. It would be preferable to impart vibrations at the gravel packing apparatus directly to minimize dampening of the vibrations.

U.S. Pat. No. 3,113,621 discloses the use of known vibration imparting tools to well liners to add gravel to a wellbore through the liner by vibrating larger sand particles through the liner than can return into the liner without vibration. The method to impart the vibration requires using known electrically driven or hydraulically driven vibrators. Thus, a 10 to 100 horsepower motor, along with a power source, must be inserted into the wellbore. It would be preferably to impart such vibration with a more simple, less expensive, and more compact source of vibration.

Bluff objects are known to shed vortices at rates which can be proportional to the flow rate of fluid passing the bluff object. This phenomena is utilized in flow rate measuring devices disclosed in, for example, U.S. Pat. Nos. 3,535,927, 3,927,566 and 4,026,150. U.S.

Pat. No. '566 further discloses the use of vortex shedding of one bluff object to move a second bluff object up and down. The second bluff object is located immediately downstream of the first bluff object. The frequency of the up and down movement of the second bluff object is, according to Birkoff's Theory, proportional to the rate of flow of the fluid past the bluff objects. Although the second bluff object could impact the walls of the flow conduit, such impacting would render the device unreliable as a flow measurement device and thereby defeat the intended purpose of the invention.

In one embodiment of the present invention, it is therefore an object to provide a method to impart vibration to a fluid flow conduit by a simple and reliable method. It is a further object to impart a vibration by a simple mechanism where the energy required for the vibration is derived from the energy of the flowing fluid.

In another embodiment, it is an object of the present invention to provide a simple method to produce a fine dispersion of fluid in another immiscible fluid.

SUMMARY OF THE INVENTION

The objects of the first embodiment of the present invention are accomplished by a method comprising constraining within a fluid flow conduit a bluff hammer movable to a plurality of positions wherein fluid flow through the fluid flow conduit causes the bluff object to move between positions wherein the direction of movement of the bluff hammer is changed after the bluff hammer impacts a wall of the fluid flow conduit; and passing fluid through the fluid flow conduit at a rate effective to move the hammer between positions and impact the wall of the fluid flow conduit.

This vibrating fluid flow conduit may be utilized as a wash pipe in a gravel packing apparatus. As a wash pipe in a gravel packing apparatus, gravel pack sand can be densely placed within a borehole. The densely placed gravel pack is considerably less prone to subsequent settling and bypassing formation solids through the gravel pack.

In another embodiment, the apparatus of the fluid flow conduit vibrator may be utilized to create a fine dispersion of one fluid in an immiscible fluid. The hammering of the bluff object against the walls of the fluid flow conduit breaks droplets of the discontinuous phase into many small droplets.

Simulated gravel packs prepared by the method of this invention were found to be sufficiently dense that subsequent vibration did not further compact the gravel pack.

BRIEF DESCRIPTION OF THE DRAWINGS

FIGS. 3 through 5 each display a means to constrain the bluff object of the present invention.

FIG. 6 shows a view along the axis of a fluid flow conduit of the present invention.

DETAILED DESCRIPTION OF THE INVENTION

Figure 1:
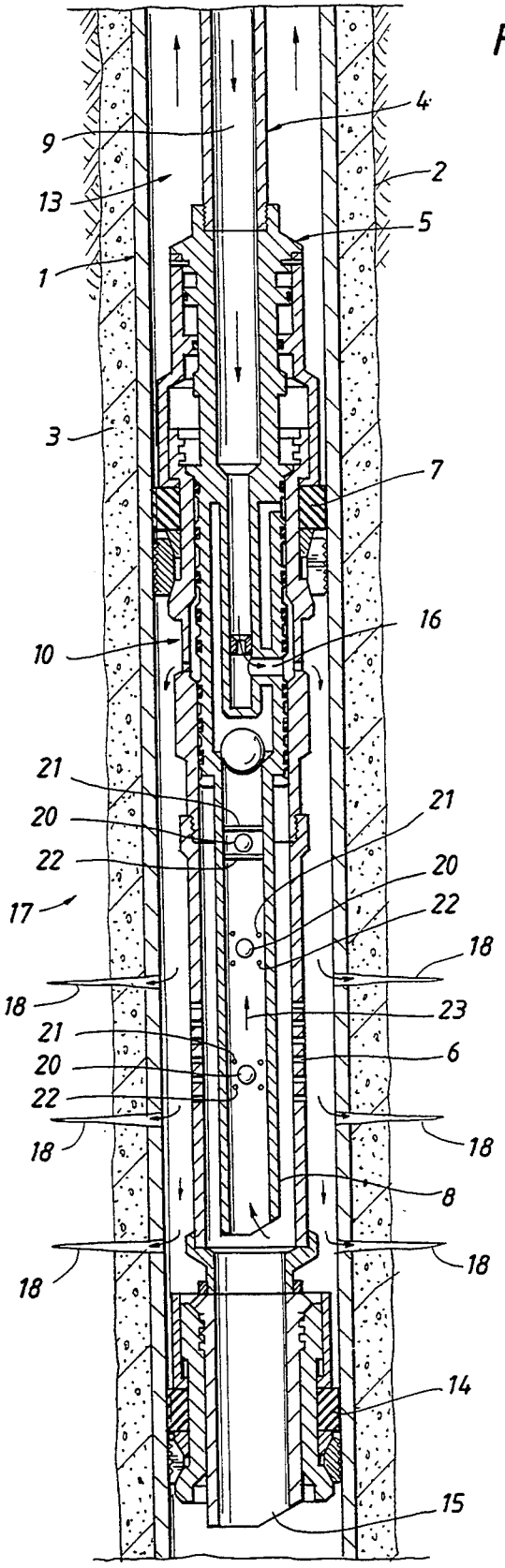
FIG. 1 is a cross sectional view of the vibrator of the present invention incorporated in a gravel packing tool.

The applicants have found that constraining a bluff movable object within a fluid flow path is a simple and reliable method to impart vibrations to a fluid flow conduit when fluid is forced through the fluid flow path. The bluff object is preferably a round ball made of a relatively dense and hard material such as steel. A bluff object of greater density imparts greater kinetic energy to the wall of the fluid flow conduit when it impacts the wall of the conduit. The bluff object serves in this invention as a hammer by pounding on the walls of the conduit as forces caused by the fluid flow move the ball back and forth. Other shapes of bluff objects may also be utilized, but round hammers are preferred.

The bluff hammer must be constrained so that it is not carried by gravity or by the fluid flow down the fluid flow conduit and away from the point where vibrations are desired. The bluff hammer must further be constrained in such a way that it can occupy a plurality of positions. The fluid flow must force the bluff hammer from one position to another, with the direction of movement changed upon impact with the bluff hammer on the wall of the flow conduit. In order for the fluid flow to force the bluff hammer from one position to another, the bluff hammer must be constrained by a means that does not create a preferred position to which fluid flow forces the bluff hammer. In one embodiment, a constraint such as a rod pivotally attached to the flow conduit is used. The rod is preferably considerably longer than the radius of the flow conduit to permit the bluff hammer to impact opposing walls of the conduit without the bluff hammer moving through a large arc. Movement through a large arc would require a significant portion of the movement to be against the flow of the fluid. This would be undesirable due to a resultant decrease in momentum prior to the hammer impacting the wall of the fluid flow conduit. The distance from the pivot point to the centroid of the hammer (i.e. the radius of the arc) is preferably greater than 10 times the maximum clearance between the hammer and the inner wall of the fluid flow conduit. Even a large arc radius will result in some movement against the flow of the fluid, but this movement is sufficiently small to result in negligible impact on the momentum of the bluff hammer with the preferred pivot arc radius.

A preferred constraint for the bluff hammer is a plurality of pins traversing the fluid flow conduit in a plane which is essentially perpendicular to the fluid flow. The pins are preferably parallel, and are close enough together that the bluff hammer cannot pass between the pins. In a preferred configuration of this embodiment, pins are each placed the same distance from the center of the flowpath. These pins then serve as a track, permitting the bluff hammer to slide back and forth between the walls of the flow conduit. In one embodiment tested the pins were placed at positions 45 degrees from the centroid of the hammer.

Parallel pins in a plane perpendicular to the fluid flowpath provide a continuous series of positions which the hammer may occupy. The movement against the normal flow of the fluid may be constrained so the hammer does not move from the position at which vibration is desired during, for example, reverse flow periods. The movement against the normal flow may be constrained by a seat in which the bluff hammer might rest, blocking reverse flow like a ball check valve.

Another constraint for the bluff hammer may be a perforated plate, orientated perpendicular to the fluid flow. The perforations are sufficiently small that the bluff hammer cannot pass through.

Another method to constrain the bluff hammer would be to attach the bluff hammer to a flexible cable or wire. The flexible cable or wire is then attached to the fluid flow conduit, thus constraining movement of the bluff hammer. The length of the wire or cable is preferably greater than about 20 times the distance between points where the bluff object impacts the walls of the fluid flow conduit. A length of cable or wire this long or longer limits the bending moment of the wire or cable.

The present invention is not limited to a single bluff hammer. A plurality of hammers could be provided. These hammers could be constrained either within a common volume, or constrained within separate volumes such that they will not impact each other. For example, a series of two to four steel balls could be strung on a cable, and the cable affixed to a stationary point in the fluid flow conduit. Alternatively, a steel ball may be placed on each end of a rod, and the rod pivotally mounted between the balls. The rod is mounted axially with the fluid flow. When multiple bluff bodies are incorporated, they may be identical to each other or they may differ in respect to shape, size and/or weight. They may also differ in the method of constraint.

In the preferred embodiment of a gravel packing tool, a plurality of bluff hammers are constrained along the length of the wash pipe to provide a maximum amount of energy input to vibrate the gravel packing tool.

The bluff hammer can have a center of gravity which differs from the center of volume. Such an off-balance hammer is expected to move more randomly within the column within which it is constrained.

A bluff object can be round, but may also be any object which is not "streamlined", as explained in U.S. Pat. No. 3,927,566, column 1, line 55 to column 2, line 6.

Although a common gravel packing tool could be easily modified to incorporate constrained bluff hammers as vibrators within the wash pipe, any other fluid flow conduit within the gravel pack slurry circulation system may also be utilized as a location for the vibrator. In particular, the drill pipe extending to the crossover tool may include vibrators of this invention, or a crossover tool may be provided with a fluid passageway fitted with a constrained bluff hammer of this invention.

Cementation of a well casing into a wellbore could also be improved by vibration of the casing during the placement of the cement. Voids in the cement can provide gaps for communication between formations. Vibration of the casing aid in movement of the cement behind the casing and improves coverage of the casing exterior with cement.

Cement is typically placed around a casing by lowering a "cement shoe" to the bottom of the casing. The "cement shoe" seals an annulus between the drillstring and the casing, and typically includes a check valve to prevent wellbore fluids from entering the drill string as the drill string is lowered into the casing. This check valve is a preferred location for the vibrator of the present invention. The check valve can be a ball type check valve constrained on the cement inlet by a seat. A ball constrained within the cement shoe can be forced against this seat to prevent wellbore fluids from passing through the cement shoe and into the drill string. A typical cement shoe includes a check ball constraint at the cement outlet which does not block flow of cement through the shoe, but which provides a single hydraulically preferred position for the ball. In the practice of the present invention, the cement outlet provides a cement outlet constraint which provides for a plurality of positions. A plurality of parallel pins perpendicular to the cement flow path would serve as such a constraint. Alternatively, a plate with a plurality of holes may serve as the constraint. Other constraints, such as those described above, could also serve as the constraints of this cement vibrator embodiment of the present invention.

In this cement vibrator embodiment, the vibrator could also be placed up the drill string at intervals such that the casing could be vibrated throughout the length of casing to be cemented.

Referring to FIG. 1, a cross sectional view of a gravel packing apparatus in a typical wellbore is shown. A casing 1 is secured in wellbore 2 by cement 3. A drill pipe 4 suspends a crossover tool 5 and a screen 6. Packer seals 7 separate the annulus surrounding the drill pipe from the annulus surrounding the screen. The crossover tool provides communication between the interior of the drill pipe 9 and the annulus surrounding the screen 10. The annulus surrounding the liner is to be packed with sand of to be retained outside of the screen 6. The crossover tool further a particle size selected to be sufficiently small to prevent formation sand from entering the screen 6, but sufficiently large provides communication from inside a wash pipe, 8, to the annulus surrounding the drill pipe in the upper borehole 13.

A production interval can be isolated from the wellbore below the production interval by a sump packer, 14. A rat hole, 15, can extend through the sump packer to provide for a volume for solids to settle.

Gravel is placed in the annulus surrounding the screen by circulating a slurry of sand in a carrier fluid to the crossover tool, 5, by way of the drill pipe, 4. The crossover tool routes the slurry through gravel pack ports, 16, to the annulus surrounding the wellbore, 10. Some of the carrier fluid will enter the formation, 17, through perforations, 18. Sand is deposited within the perforations from carrier fluid entering the formation through the perforations. The remaining carrier fluid passes through the screen, 6, leaving sand in the annulus surrounding the screen, 10. The carrier fluid within the screen enters the lower open end of the wash pipe, 8, and is passed to the crossover tool, 5. The crossover tool directs the carrier fluid from the wash pipe, 8, to the annulus, 13 around the drill pipe, 4, above the packer, 7. Though this annulus carrier fluid is returned to the surface.

When gravel packing is complete, the crossover tool, 5, and wash pipe, 8, are removed. A sleeve (not shown), can be placed within the packer 7, covering gravel pack ports, 16, to isolate the perforated-gravel packed production interval from the wellbore above the packers, 7. A production tubing and any necessary artificial lift means (not shown) can then be placed in or above the screen to permit production from the well.

The gravel packing tool described above is typical of that used within the industry. The improvement of the present invention is shown as bluff hammers 20 within the wash pipe, 8. Three bluff hammers are shown in FIG. 1. Movement of the bluff hammers is constrained by parallel pins 21 perpendicular to the fluid flow path 23. Movement of the bluff objects in the direction against the fluid flow is also constrained by parallel pins, perpendicular to the fluid flow path 22.

Carrier fluid return flow will cause the bluff hammers 20 which are shown as round balls, to bang back and forth against the walls of the wash pipe 8, causing a vibration within the apparatus and the fluids within the wellbore. This vibration is effective in eliminating or reducing bridging of the sand and voids of sand within the packed annulus between the liner 6 and the wellbore.

Figure 2:
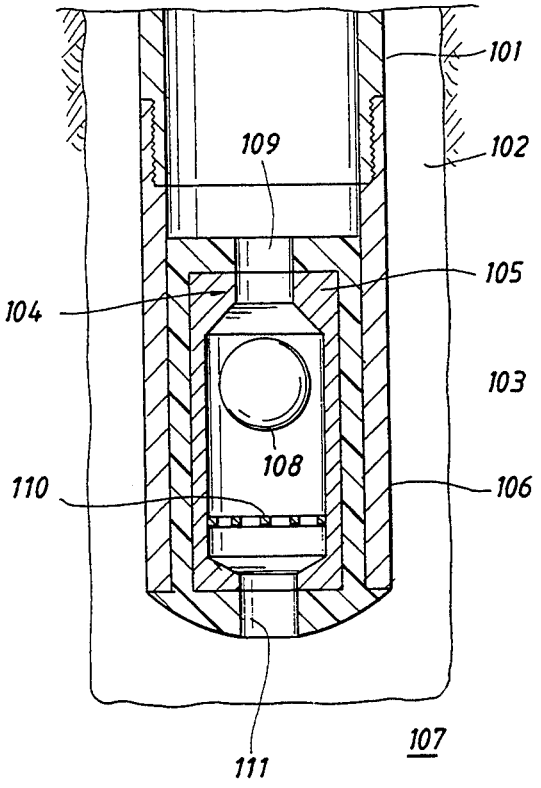
FIG. 2 is a cross sectional view of the vibrator of the present invention incorporated in a cement shoe.

FIG. 2 shows the present invention incorporated into a cement shoe as a vibrator useful for vibrating a casing during the placement of the cement. A casing 101 extends into a borehole 102 within a formation 107. A cement shoe 103 is suspended from the casing 101. A cement shoe comprises a metal body 104 suspended by a millable material such as cement 105 within a casing shoe 106. Cement shoes are usually equipped with check valves to permit cement to be forced out of the casing while keeping wellbore contents out of the casing as the casing is being lowered into the wellbore. A ball check valve is shown in FIG. 2 with a ball 108 which seats against an insert 104 at the inlet port 109, preventing wellbore contents from entering the interior of the casing. In one cement shoe embodiment of the present invention, the movement of the ball of the present invention is constrained by a perforated plate 110 such that the ball 108 is moved laterally back and forth against the interior surfaces of the shoe by the flow of cement through the shoe. During the process of placing the cement around the casing, cement is forced as a liquid from the inside of the casing through the inlet port 109, past the ball 108 which serves as the bluff hammer of the present invention, through the ball movement constraining mechanism, shown as a perforated plate 110, through an outlet port 111, then up the wellbore outside of the casing. The cement is followed by a wiper plug (not shown) to ensure that the cement is displaced from the interior of the casing. The cement is then allowed to set. After the cement is set, the wiper plug and cement shoe can be drilled through to provide for a deeper wellbore.

FIG. 3 shows an embodiment of the present invention where movement of a bluff hammer is constrained by a cable 201. The cable 201 extends through a hole in a ball 202, which serves as the bluff hammer. The cable is secured to the wall of the flow channel wall by a metal clamp 203 after the cable passes through a hole in the ball. The cable is secured to the wall of the fluid flow channel 207 by a bolt 204, nut 205, and washer 206.

FIG. 4 shows an embodiment of the present invention where two balls 301 are attached to opposing ends of a rod 302 which is pivotally mounted at about the center of the rod. The pivotal mounting is shown as a pin 303 which passes through a reinforced hole 304 in the rod 302. Each end of the pin 303 may be secured outside of a fluid flow channel 305 by nuts 306 which are threadably connected to the pin. In FIG. 4, the balls are attached to the rod by threaded female connections within the ball. Alternatively, the rod may be connected to the ball by a weld, or strap.

FIG. 5 shows a preferred method to constrain a bluff hammer. The movement of the bluff hammer object, ball 401, is constrained by a pivoting rod 402. The bail is shown connected to the pivoting rod 402 by two nuts 403 and 404, threaded onto the rod 402, on either side of the ball 401. Of course, the nut 404 is optional because centrifugal force and fluid drag will maintain the ball against the outer nut 403. Due to vibrations which will occur during normal operation of the vibrators of this invention, each nut is preferably secured by a lock washer or a cotter pin through a hole within the threads of the threaded rod (not shown), or by welding the nut in place. FIG. 5 shows a pivoting end of the rod 402 connected to a washer or bearing 409, swinging freely on a pin 410. The washer or bearing 409 may be kept substantially centered within the flow channel by two sleeves 405 and 406, one on each side of the washer or bearing. The pivot pin 410 can be secured to the walls of the flow channel 407 by nuts 408, thread on the pin, and against the flow channel 407. A hammer constrained by such a method will generally vibrate whether the fluid flow is in the direction of from the pivot point to the hammer of from the hammer to the pivot point.

The reason a bluff object with constrained movement along an axis of fluid flow will move back and forth is shown by FIG. 6. FIG. 6 is a cross-sectional view of a bluff hammer, in a cylindrical fluid flow path looking along the axis of flow. The bluff hammer, a ball 501, is off-center within the cylinder, shown as a pipe 502. Fluids will flow around the bluff object taking a path of least resistance. The half of the ball closest to a wall of the pipe 503 will be exposed to moving fluids of a lower velocity than that of the half of the ball not farthest from the pipe wall 504. Because of the laws of fluid mechanics the pressure exerted on the ball by the fluid will be greater on the side closest to the wall due to the lower fluid velocity on that side of the ball. A familiar example of this law is referred to as Bernoulli's theorem which states that for an ideal fluid flowing along a streamline, pressure head, velocity head, and elevation head are conserved. Thus, lower regions exhibit higher pressures and higher velocity regions exhibit lower pressures. A ball in a position next to a wall of a flow chamber will therefore be subjected to a lateral force by pressure exerted by the fluid, urging the ball toward the center of the pipe. Although this force reverses itself as the ball passes the center, momentum of the ball will carry it to the wall if the movement is not otherwise constrained. A nearly elastic collision with the wall will reverse the direction of movement of the ball, sending it toward the side of the pipe originally closest to the ball. Although round balls are shown as the bluff hammer in the drawings, and a pipe of a round cross section is shown as the fluid flow conduit, it can be seen that the present invention is in no way limited to these particular shapes. A round ball is a convenient hammer due to the impact on the flow conduit wall being uniform regardless of the orientation of the hammer, and a pipe of a circular cross section is convenient fluid flow conduit due to uniformity of the vibrations that emit from such a flow conduit.

For a round ball within a pipe of a circular cross section, the frequency of the impacts on the pipe walls have been found to be conveniently estimated by the following equation.

$$Str = \left[ \frac{3/4\ Cl\ K + Fr}{4\pi^2(\rho_b/\rho_f + 1/2)} \right]^{\frac{1}{2}}$$

where:

$$Str = \text{Strouhal Number} = F\frac{\sqrt{d(D-d)}}{V_{avg}}$$

$$Fr = \text{Froude Number} = \frac{gd}{V_{avg}}(\rho_b/\rho_f - 1)$$

F=Ball vibration frequency
d=ball diameter
D=Pipe inside diameter $V_{avg}$=flow velocity average within cross-section at ball center=

$$Q/\left[\frac{\pi}{4}(D^2-d^2)\right]$$

where Q=total volumetric rate of flow
Cl=lift coefficient on the ball
K=constant=1.299
g=acceleration due to gravity
Pb=ball density
Pf=fluid density The energy imparted by the ball to the walls of the fluid flow conduit comes at the expense of pressure drop in the fluid flow. This pressure drop can be estimated for a ball in a cylindrical pipe by the following equation:

$$\Delta P=\frac{fp_f(1-d/D)\,V_{avg}^2}{2\,g_c}$$

where ΔP is the pressure drop imparted by the vibrating ball of this invention, f is a friction factor which can be estimated as:

$$f=\frac{595.7\,M\mu}{(D-d)\,V_{avg}\,\rho f}+0.1096$$

where Mu is the fluid viscosity, and $g_c$ is a conversion factor=32.174 LBm FT/LBm Sec$^2$.

A correlation to define the lift coefficient, Cl, for the ball within a pipe is not presently known, but it could be easily determined by back-calculation using experimentally measured frequencies and known rates of flow. In general, it is expected that $C_1$ will depend on the Reynolds Number (D-d) Vavg $p_f/M\mu$. For data obtained with water $C_1=1$ gives a good fit of the observed vibration measurement.

From the above equations it can be seen that the choice of the relative size of the bluff hammer and the fluid flow conduit may be made considering factors such as the frequency of vibration desired, the energy to be imparted by way of the vibrations, and the tolerable fluid flow pressure drop. The bluff hammer preferably is of an average diameter of about $\frac{3}{4}$ to $\frac{7}{8}$ of the flow conduit average diameter. A hammer of this size imparts a desirable frequency and amplitude of vibration.

The vibrator of the present invention also serves as an excellent mixing and emulsifying device. Immiscible fluids may be mixed by the apparatus described above resulting in a fine dispersion of a discontinuous phase within a continuous immiscible phase. Oil droplets in the range of 1 micron average diameter can be produced by mixing a mineral oil in fresh water by the present invention.

Although the present invention has been described in preferred embodiments of a gravel pack tool, process and a well casing cementing tool and process, and a process and apparatus to mix fluids, it is readily apparent that the present invention can be applied to a wide variety of applications where vibration of a fluid flow conduit is desired, or where vibration is desired and fluid flow can be provided to supply a convenient source of energy for the vibration.

EXAMPLE

A simulated gravel pack was performed by pumping a slurry of sand in water through a 32 foot long horizontal 3" casing containing a 1.94 inch diameter slotted screen. A wash pipe of a 0.995 inch internal diameter was placed within the screen. The slurry was pumped in to the casing, and return water was removed through the wash pipe at various flow rates.

The wash pipe was fitted with three steel balls of $\frac{7}{8}$ inch diameter. The balls were constrained in separate sections of the wash pipe by three sets of two pins placed through the wash pipe. The slurry was pumped into the casing. Sand was deposited between the casing and the slotted liner, and return carrier water was returned through the wash pipe. Table 1 lists the flow rate of carrier fluid removed from the wash pipe, the frequency, F, of the vibrations and the pressure drop across the three balls.

TABLE 1

| Flow GPM | Delta P PSI | F Sec$^{-1}$ |
|---|---|---|
| 1 | 0.08 | 11.6 |
| 2 | 0.29 | 17.2 |
| 3 | 0.61 | 22.1 |
| 4 | 1.06 | 26.5 |
| 5 | 1.63 | 30.8 |
| 6 | 2.32 | 34.9 |
| 7 | 3.13 | 38.9 |
| 8 | 4.06 | 42.9 |
| 9 | 5.12 | 46.8 |
| 10 | 6.29 | 50.7 |
| 11 | 7.59 | 54.5 |
| 12 | 9.01 | 58.4 |
| 13 | 10.55 | 62.2 |
| 14 | 12.21 | 66.0 |
| 15 | 14.00 | 69.7 |
| 16 | 15.90 | 73.5 |
| 17 | 17.93 | 77.3 |
| 18 | 20.08 | 81.0 |
| 19 | 22.35 | 84.8 |
| 20 | 24.74 | 88.5 |
| 21 | 27.26 | 92.3 |
| 22 | 29.89 | 96.0 |
| 23 | 32.65 | 99.7 |
| 24 | 35.53 | 103.4 |
| 25 | 38.53 | 107.2 |
| 26 | 41.65 | 110.9 |
| 27 | 44.89 | 114.6 |
| 28 | 48.26 | 118.3 |
| 29 | 51.74 | 122.0 |
| 30 | 55.35 | 125.7 |
| 31 | 59.08 | 129.4 |
| 32 | 62.93 | 133.1 |
| 33 | 66.90 | 136.8 |
| 34 | 71.00 | 140.5 |
| 35 | 75.21 | 144.3 |

The effectiveness of the method and apparatus in gravel packing is demonstrated by a simulated gravel similar to that described above but without the vibration in place. After the slurry was placed in the casing, the length of the gravel pack was measured. Water was then circulated through the gravel pack as the apparatus was vibrated by an external vibrator. The length of the gravel pack consistently decreased by about 7 to 8 percent upon the external vibration. Applying similar external vibration and water circulation to a gravel pack placed with vibration in the same apparatus equipped with vibration according to the present invention resulted in no measurable decrease in gravel pack length. This demonstrates the effectiveness of wash pipe vibration in achieving a gravel pack density which approaches that which would be ultimately possible with unlimited vibration.

The foregoing description of the invention is merely intended to be explanatory thereof, and various changes in the details of the described method and apparatus may be made within the scope of the appended claims without departing from the spirit of the invention.

We claim:

1. A process to prepare a fine dispersion of a discontinuous phase of a first fluid within an immiscible second fluid comprising:

combining the first fluid and the second fluid;

passing the combined first and second fluid through a fluid flow conduit; and constraining within the fluid flow conduit a bluff hammer movable to a plurality of positions wherein fluid flow through the fluid flow conduit causes the bluff hammer to move between positions and change direction of movement of the bluff hammer after the bluff hammer impacts a wall of the fluid flow conduit.

* * * * *